US008882236B1

(12) United States Patent
Kroon

(10) Patent No.: US 8,882,236 B1
(45) Date of Patent: Nov. 11, 2014

(54) SYSTEM AND METHOD FOR COMPENSATING FOR DEFECTIVE INKJETS EJECTING BLACK INK IN SOLID FILL AREAS

(71) Applicant: Xerox Corporation, Norwalk, CT (US)

(72) Inventor: Stephen M. Kroon, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/906,481

(22) Filed: May 31, 2013

(51) Int. Cl.
*B41J 29/393* (2006.01)
*B41J 2/045* (2006.01)

(52) U.S. Cl.
CPC ..... *B41J 2/0451* (2013.01); *B41J 2/04508* (2013.01)
USPC ..... 347/19; 347/40; 347/88

(58) Field of Classification Search
USPC ..... 347/19, 40, 43, 47, 88, 99
See application file for complete search history.

(56) References Cited

U.S. PATENT DOCUMENTS

| | | | | |
|---|---|---|---|---|
| 5,764,252 | A * | 6/1998 | Burr et al. | 347/20 |
| 6,354,693 | B1 | 3/2002 | Looman et al. | |
| 6,565,180 | B2 | 5/2003 | Yu et al. | |
| 7,422,299 | B2 | 9/2008 | Mantell et al. | |
| 8,042,899 | B2 | 10/2011 | Folkins et al. | |
| 2006/0055734 | A1* | 3/2006 | Kadomatsu et al. | 347/55 |
| 2007/0070111 | A1* | 3/2007 | Vladislav | 347/19 |
| 2008/0186371 | A1* | 8/2008 | Banning | 347/99 |
| 2009/0315939 | A1 | 12/2009 | Mantell et al. | |
| 2011/0304665 | A1 | 12/2011 | Mantell | |
| 2012/0075370 | A1 | 3/2012 | Ramakrishnan et al. | |
| 2012/0092409 | A1* | 4/2012 | Wu et al. | 347/19 |

* cited by examiner

*Primary Examiner* — Julian Huffman
*Assistant Examiner* — Sharon A Polk
(74) *Attorney, Agent, or Firm* — Maginot Moore & Beck LLP

(57) ABSTRACT

A method of solid ink printer operation compensates for missing black ink in solid fill areas. The method includes ejecting at least one other color of ink into a black solid fill area at a predetermined distance to the area missing the black ink. The additional non-black ink urges black ink between the non-black ink and the area missing the black ink to migrate into the area in which the black ink is missing.

8 Claims, 5 Drawing Sheets

| | 0 | 1 | 2 | 3 | 4 | 5 | 6 |
|---|---|---|---|---|---|---|---|
| 0 | K | KCY | K | | K | KMC | K |
| 1 | K | KYM | K | | K | KCY | K |
| 2 | K | KMC | K | | K | KYM | K |
| 3 | K | KCY | K | | K | KMC | K |
| 4 | K | KYM | K | | K | KCY | K |
| 5 | K | KMC | K | | K | KYM | K |
| 6 | K | KCY | K | | K | KYC | K |

FIG. 2

SYSTEM AND METHOD FOR COMPENSATING FOR DEFECTIVE INKJETS EJECTING BLACK INK IN SOLID FILL AREAS

TECHNICAL FIELD

The present disclosure relates generally to inkjet imaging apparatus and, more particularly, to the compensation for missing black ink in solid fill areas.

BACKGROUND

Drop on demand inkjet technology for producing printed media has been employed in commercial products such as printers, plotters, and facsimile machines. Generally, an inkjet image is formed by selectively ejecting ink drops onto an image substrate from a plurality of drop generators or inkjets, which are arranged in a printhead or a printhead assembly. For example, the printhead assembly and the image substrate are moved relative to one another and the inkjets are controlled to eject ink drops at appropriate times. The timing of the inkjet activation is performed by a printhead controller, which generates firing signals that selective activate inkjets to eject ink onto an image substrate. The image substrate may be an intermediate image member, such as a print drum or belt, from which the ink image is later transferred to a print medium, such as paper. The image substrate may also be a moving web of print medium or sheets of a print medium onto which the ink drops are directly ejected. The ink ejected from the inkjets may be liquid ink, such as aqueous, solvent, oil based, UV curable ink or the like, which is stored in containers installed in the printer. Alternatively, the ink may be loaded in a solid form and delivered to a melting device, which heats the solid ink to its melting temperature to generate liquid ink, which is supplied to a printhead.

During the operational life of an inkjet printer, inkjets in one or more of the printheads may become unable to eject ink in response to receiving a firing signal. The defective or inoperative condition of the inkjet may temporarily persist so the inkjet becomes operational after one or more image printing cycles. In other cases, the inkjet may remain unable to eject ink until a purge cycle is performed. A purge cycle may successfully unclog inkjets so that they are able to eject ink once again. Execution of a purge cycle, however, requires the imaging apparatus to be taken out of its image generating mode. Thus, purge cycles affect the throughput rate of an imaging apparatus and are preferably performed during downtime.

Compensation methods have been developed that enable an imaging apparatus to generate images even though one or more inkjets in the imaging apparatus are unable to eject ink. These compensation methods cooperate with image rendering methods to control the generation of firing signals for inkjets in a printhead. Rendering refers to the processes that receive input image data values and generate output image values. The output image values are used to generate firing signals, which cause the inkjets of a printhead to eject ink onto the recording media. Once the output image values are generated, a compensation method may use information regarding defective, also called inoperative, inkjets detected in a printhead to identify the output image data values that correspond to one or more defective inkjets in the printhead. The compensation method then finds a neighboring or nearby output image data value that can be adjusted to compensate for the defective inkjet. Preferably, an increase in the amount of ink ejected near the defective inkjet may be achieved by replacing a zero or nearly zero output image value with the output image value that corresponds to the defective inkjet.

Previously known compensation methods are useful for many situations, but some scenarios present issues regarding the camouflaging of missing inkjets, particularly in solid ink printers. One scenario involves the camouflaging of a missing inkjet that ejects black ink in a solid fill area. When a printer prints a solid fill area, almost all of the inkjets nearby the defective inkjet are ejecting ink into the area. Consequently, the firing signals to these inkjets cannot be modify to eject more ink into the area as most or all of the inkjets are at or near a maximum ink ejection amount. Additionally, placing more black ink adjacent an area devoid of black ink emphasizes the absence of the black ink rather than attenuating the absence. To address these problems, nearby inkjets in printheads that eject ink of a color other than black have been used to eject one or more inks of another color into the missing black ink gap. When this approach is used in a solid ink printer, however, the resulting gap is sometimes detectable. Solid inks are typically pressed against the media onto which the ink has been ejected by a spreader nip to present a more uniform appearance. When non-black inks are ejected into a gap in a black solid fill area, this spreading has been observed to restrict the spreading of black ink into the gap. Consequently, while the ink in the gap is not as noticeable as bare media, the ink in the gap still presents sufficient color contrast that the ink in the gap can be differentiated from the black ink on either side of the gap by an observer of the printed media. Therefore, compensation for missing black ink in a solid fill area, especially in a solid fill area produced by a solid ink printer, that presents a more uniform appearance would be useful.

SUMMARY

A new method of compensating for missing inkjets ejecting solid black ink in solid fill areas better camouflages the absence of the black ink. The method comprises detecting with a controller an inoperative inkjet in a printhead that ejects black ink, detecting with the controller pixels in image data to be printed by the inoperative inkjet in a solid fill area, operating with the controller inkjets to eject ink that is a first color other than black into the solid fill area into which the printhead ejects black ink, and spreading in a nip the ink drops of the color other than black and the black ink drops in the solid fill area to urge a portion of the black ink in the solid fill area into a portion of the solid fill area into which the inoperative inkjet was to eject ink drops corresponding to the detected pixels in the image data.

A printing system implements the new method that compensates for missing inkjets ejecting black ink in solid fill areas. The printing system includes at least one printhead, a media transport configured to move media past the printhead in a process direction to enable ink to be ejected onto the media, a nip formed between two rollers, the nip being positioned to receive the media after ink is ejected onto the media by the at least one printhead to enable the ink on the media to be spread, and a controller operatively connected to the printhead and the media transport, the controller being configured to: detect an inoperative inkjet in the printhead that ejects black ink, detect pixels in image data to be printed by the inoperative inkjet in a solid ink fill area, and operate inkjets to eject ink that is a first color other than black into the solid fill area into which the inkjets eject black ink to enable the nip to spread the ink drops of the color other than black and the black ink drops in the solid fill area to urge a portion of the black ink in the solid fill area into a portion of the solid fill area into which the inoperative inkjet was to eject ink drops corresponding to the detected pixels in the image data.

Another method uses clear ink in solid fill areas printed with black ink to compensate for inoperative inkjets that eject black ink. The method includes detecting with a controller an inoperative inkjet in a printhead that ejects black ink, detecting with the controller pixels in image data to be printed by the inoperative inkjet in a solid fill area, operating with the controller inkjets to eject clear ink into the solid fill area into which the printhead ejects black ink, and spreading in a nip the clear ink drops and the black ink drops in the solid fill area to urge a portion of the black ink in the solid fill area into a portion of the solid fill area into which the inoperative inkjet was to eject ink drops corresponding to the detected pixels in the image data.

BRIEF DESCRIPTION OF THE DRAWINGS

The foregoing aspects and other features of an inkjet printing apparatus, which enables visually detection of defective inkjets in a printhead are explained in the following description, taken in connection with the accompanying drawings.

FIG. 2 illustrates a portion of a solid fill area in which different color ink has been ejected to promote migration of black ink into the missing black ink gap.

DETAILED DESCRIPTION

Figure 1:
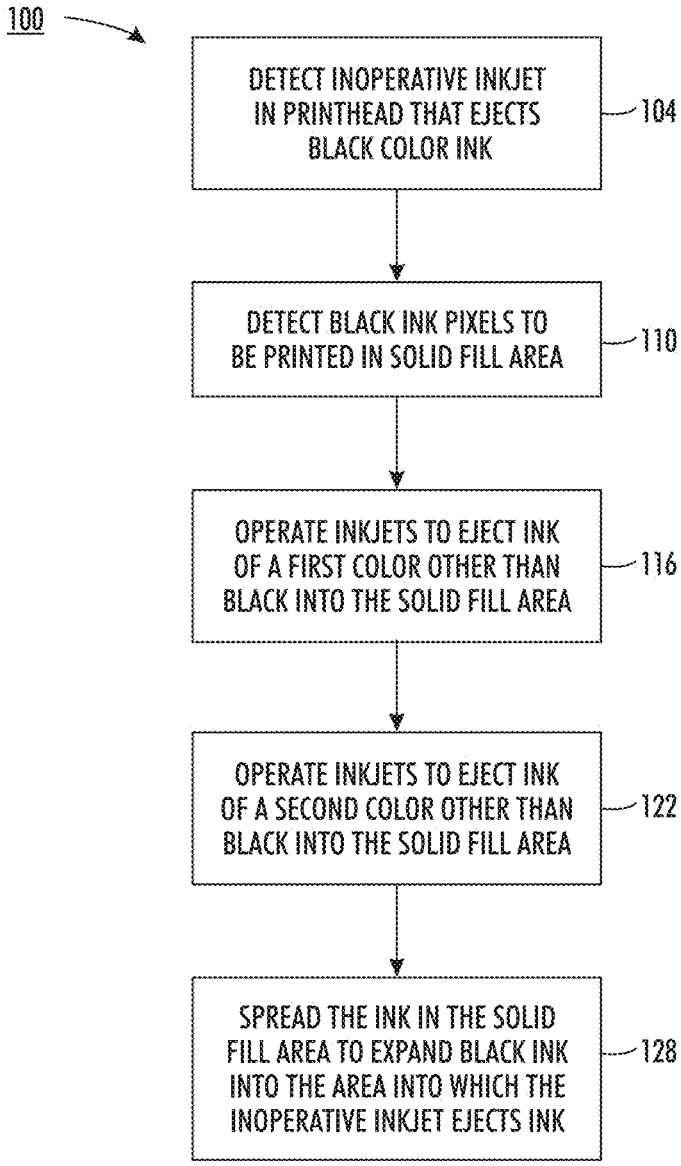
FIG. 1 is a flow diagram of a process for compensating for missing black ink in a solid fill area.

For a general understanding of the environment for the system and method disclosed herein and the details for the system and method, reference is made to the drawings. In the drawings, like reference numerals have been used throughout to designate like elements. As used herein, the words "printer" and "imaging apparatus", which may be used interchangeably, encompasses any apparatus that performs a print outputting function for any purpose, such as a digital copier, bookmaking machine, facsimile machine, a multi-function machine, etc. Furthermore, a printer is an apparatus that forms images with marking material on media and fixes and/or cures the images before the media exits the printer for collection or further printing by a subsequent printer.

Figure 3:
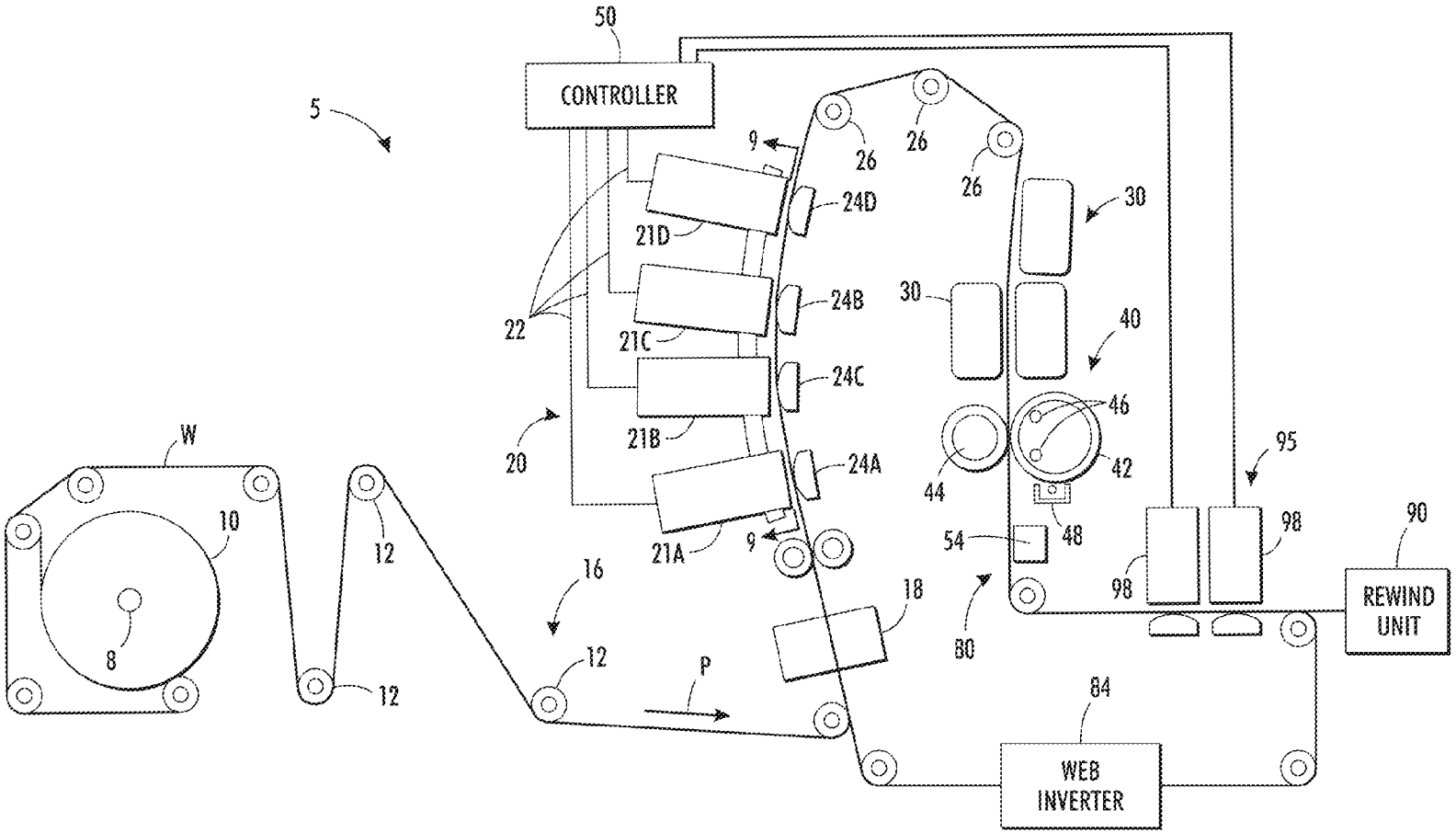
FIG. 3 Prior Art
FIG. 3 illustrates a prior art inkjet printing apparatus in which a system and method that better compensates for missing black ink in solid fill areas can be implemented.

FIG. 3 depicts an imaging apparatus 5 in which the method described in this document to compensate for missing, intermittent, or weak inkjets that eject black ink can be implemented. The imaging apparatus 5 can implement a solid ink print process for printing onto a continuous media web. The imaging apparatus 5 shown in FIG. 3 forms a printed image on media by ejecting ink droplets from a plurality of inkjets arranged in one or more printheads. During the course of printing, one or more of the inkjets may become unavailable to eject ink. The system described herein implements a method of defective inkjet detection, which enables a user to detect defective inkjets in high density coverage areas and identify the defective inkjets through a user interface to enable a controller in the printer to compensate for the defective inkjets. For example, a functional inkjet, referred to as a compensating inkjet, can be used to eject ink in place of an identified defective inkjet. Once the defective inkjets are identified through the user interface, they are deactivated by a printer controller and no longer used for printing until a maintenance operation is performed, which may rehabilitate the defective inkjets.

The imaging apparatus 5 includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The direct-to-sheet, continuous-media, phase-change inkjet imaging apparatus 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging apparatus. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color module effectively extends across the width of the media and is able to eject ink directly (i.e., without use of an intermediate or offset member) onto the moving media. The arrangement of printheads in the print zone of the system 5 is discussed in more detail with reference to FIG. 4 below.

The imaging apparatus may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. Following the mid-heaters 30, a fixing assembly 40 is configured to apply heat and/or pressure to the media to fix the images to the media. The term "fixing" may refer to the stabilization of ink on media through components operating on the ink and/or the media, including, but not limited to, fixing rollers and the like. In the embodiment of the FIG. 3, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. The spreader 40 includes rollers, such as image-side roller 42 and pressure roller 44, to apply heat and pressure to the media. Either roller can include heat elements, such as heating elements 46, to bring the web W to a temperature in a range from about 35° C. to about 80° C.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant, but the clear ink can affect appearance parameters, such as image glossiness.

Following passage through the spreader 40, the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the compensation function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the printheads of color modules 21A-21D in order to operate the printheads to form the test patterns with indicia described below to enable visual detection of defective inkjets.

The imaging apparatus 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The optical imaging system may include an array of optical detectors/sensors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

Figure 4:
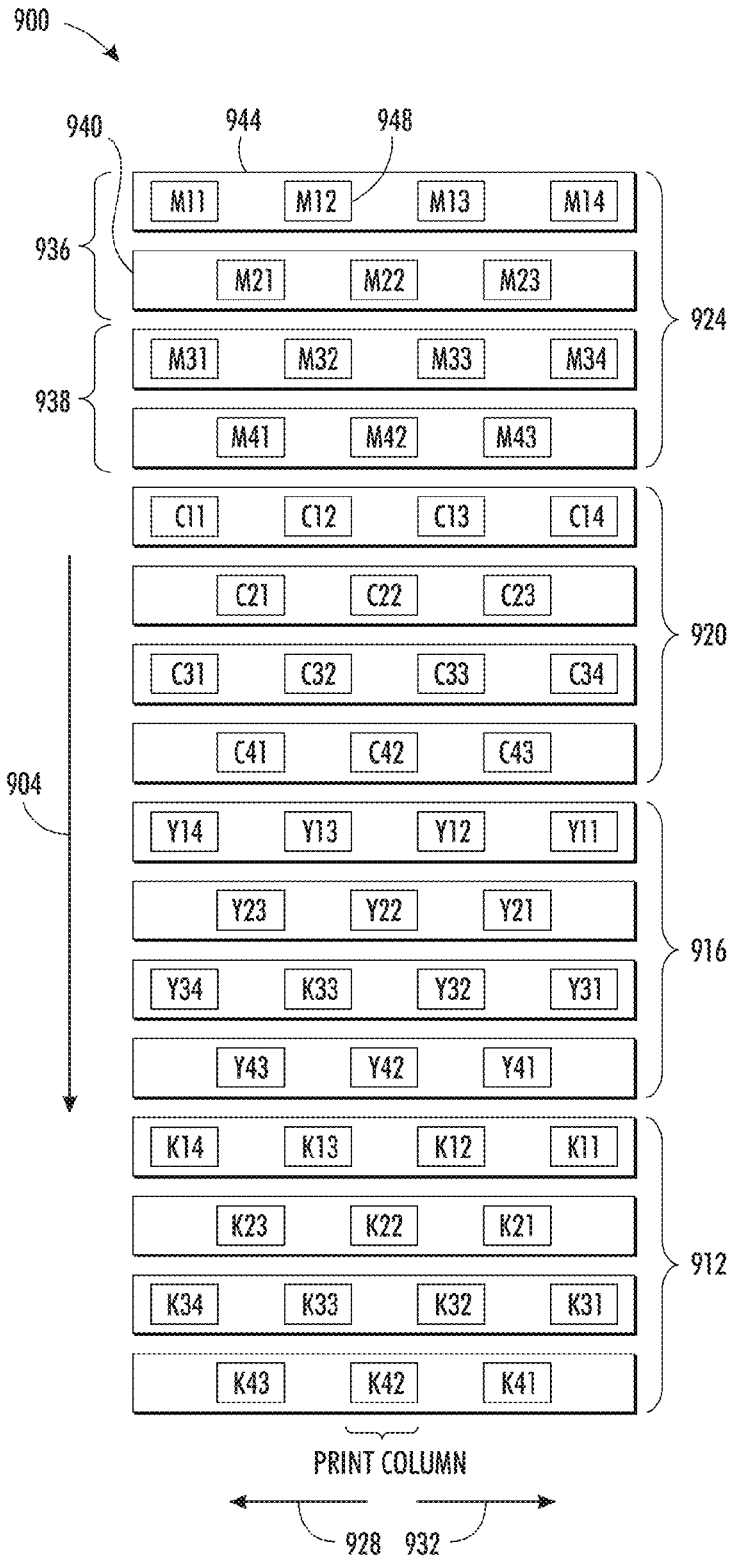
FIG. 4 Prior Art
FIG. 4 illustrates a schematic view of a prior art printhead configuration viewed along lines 9-9 in FIG. 3.

A schematic view of a prior art print zone 900 that may be used in the imaging apparatus 5 is depicted in FIG. 4. The printheads of this print zone can be operated as described below to print a test pattern with indicia that enables visual detection of defective inkjets. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as it travels under the color unit from color unit 924 to color unit 912. The arrows 928 and 932 indicate the cross-process direction across the web and the words "Print Column" refer to the lines printed by the inkjet ejectors in the printheads M22, M42, C22, C42, Y22, Y42, B22, and B42 that extend in the process direction. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Figure 5:
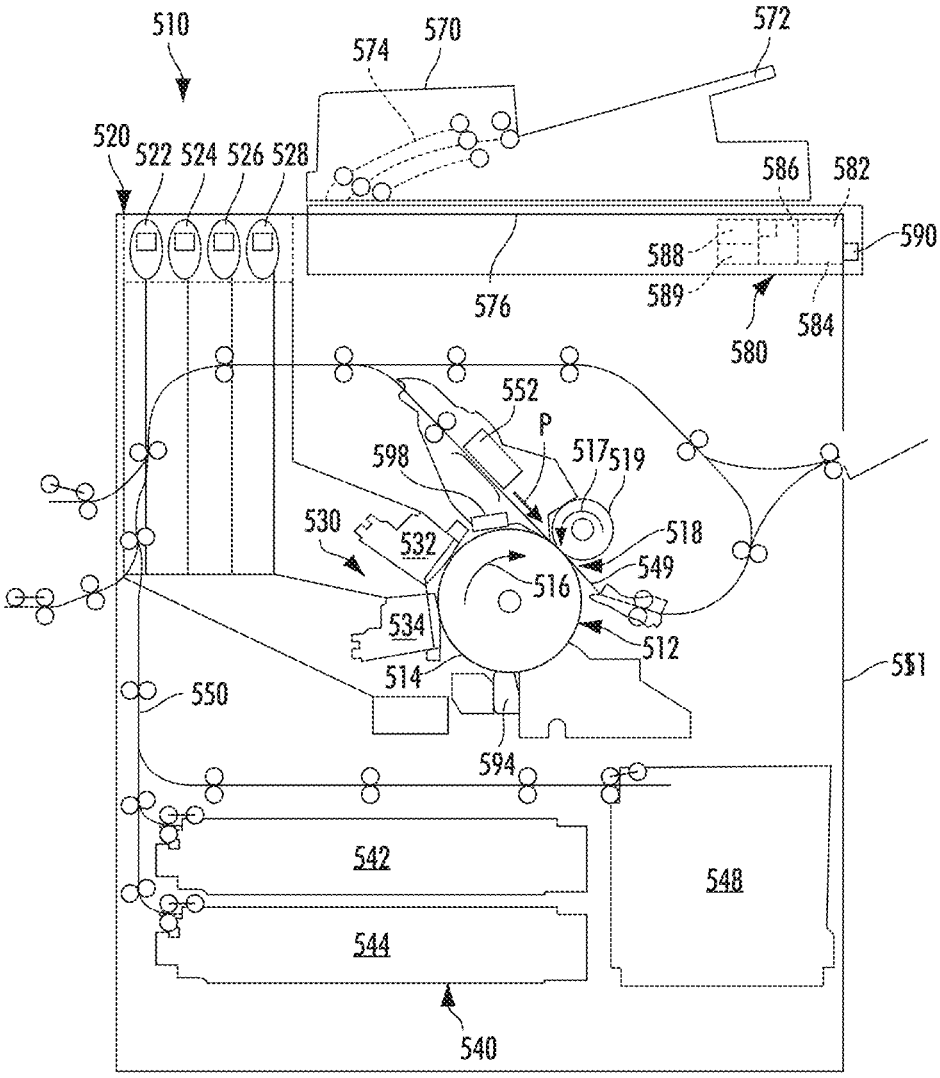
FIG. 5 PRIOR ART
FIG. 5 illustrates a prior art inkjet printing apparatus that uses an intermediate print process in which a system and method that better compensates for missing black ink in solid fill areas can be implemented.

Although the system and method disclosed herein are described with reference to the printer 5, the system and method can also be implemented in intermediate printing process printers. Such a printer is shown in FIG. 5. The printer 500 has a housing 511. Within the housing, image surface 514 of rotating image drum 512 has a layer of release agent, such as silicone oil, applied to the surface by release agent applicator 594. An ink delivery system 520 includes ink supplies 522, 524, 526, and 528 that supply ink to the printing assembly 530 having printhead arrays 532 and 534. As the drum rotates in direction 516 past the printhead arrays 532 and 534, the printheads eject ink onto the layer of release agent during one or more passes of the surface past the printheads to form an ink image. The printhead arrays can be comprised of a single printhead that ejects a plurality of different ink colors or the arrays can be an arrangement of a plurality of printheads, each of which ejects a single ink color or a plurality of different ink colors. After the ink image is formed, a sheet of media is moved by media transport 550 from one of the media trays 542, 544, and 548 in media storage 540 to the surface 514 of rotating drum 512. The media is heated by heater 552 before the ink image is transferred to the media sheet. Delivery of the media to the nip formed between transfix roller 519 and rotating drum 512 is synchronized to arrive at the nip as the ink image on the surface 514 reaches the nip. In the nip, the ink image is transferred and fixed to the media sheet. The printheads in these printers can be arranged in staggered arrays similar to those shown in FIG. 4. In some of these intermediate print process printers, each printhead can eject more than one color of ink.

The printer 500 also includes an original document feeder 570 that has a document holding tray 572, document sheet feeding and retrieval devices 574, and a document exposure and scanning subsystem 576. Operation and control of the various subsystems, components and functions of the printer 500 are performed with the aid of a controller or electronic subsystem (ESS) 580. The ESS or controller 580, for example, is a self-contained, dedicated mini-computer having a central processor unit (CPU) 582 with a digital memory 584, and a display or user interface (UI) 586. The ESS or controller 580, for example, includes a sensor input and control circuit 588 as well as an ink drop placement and control circuit 589. In one embodiment, the ink drop placement control circuit 589 is implemented as a field programmable gate array (FPGA). In addition, the CPU 582 reads, captures, prepares and manages the image data flow associated with print jobs received from image input sources, such as the scanning system 576, or an online or a work station connection 590. As such, the ESS or controller 580 is the main multi-tasking processor for operating and controlling all of the other printer subsystems and functions. As noted above with regard to the controller of printer 5 in FIG. 3, the controller 80 can be implemented with general or specialized programmable processors that execute programmed instructions, for example, printhead operation.

While the system and method of compensating for inoperative inkjets that eject black ink are discussed in the context of a solid ink imaging apparatus, they can also be used with imaging apparatus that use other types of liquid ink, such as aqueous, emulsified, gel, UV curable inks, or inks having magnetic properties such as those used in magnetic ink character recognitions systems ("MICR"). Therefore, the system and method can be used in any imaging apparatus that provides liquid ink to one or more printheads, including cartridge inkjet systems.

A method for operating inkjets in a plurality of printheads in a printer to compensate for missing black ink in a solid ink fill area is shown in FIG. 1. In the description of the method, a statement that the process does some function or performs some action refers to a controller executing programmed instructions to do the function or perform the action or to the controller generating signals to operate one or more electrical or electromechanical components to perform the function or action. While process 100 is described with reference to a printer that ejects melted phase change ink, it could be implemented with printers that eject other types of ink. The process 100 begins with the controller detecting an inoperative inkjet in a printhead that ejects melted black solid ink (block 104). The detection can be implemented with the controller operating the printheads to print a test pattern that a user can observe to detect a missing black inkjet. The user then manipulates a user interface to enter data that identifies the missing black inkjet and the controller stores these data in memory for later access. The test pattern can also or alternatively pass an optical sensor that directs light towards the test pattern and captures the electrical signals generated by optical detectors in the optical sensor in response to the reflected light received by the optical detectors. These image data can be processed by a controller executing programmed instructions stored in a memory to analyze the image data to detect missing inkjets ejecting black ink. These identifying data can be stored in the memory to be later accessed by the controller. Thus, detection of the inoperative inkjet by the controller can occur after image data for an image to be printed is rendered and then the controller accesses the memory to detect any defective inkjets that eject black ink. The pixels to be printed by an inkjet so identified are then further processed as set forth in process 100.

The process 100 continues with the controller detecting pixels in image data to be printed by the inoperative inkjet in a solid fill area (block 110). That is, the controller determines whether the black ink pixels in the vicinity of the pixels to be printed by the inoperative inkjet are dense enough to classify the area as a solid fill area. As used in this document "solid fill area" refers to a number of pixels to be printed in an area having predetermined dimensions measured by pixels, which is centered about a column of pixels to be printed by an inoperative inkjet. For example, the number of pixels to be printed in a seven by seven pixel area centered about a seven pixel long column to be printed by an inoperative inkjet is used to evaluate whether the area is a solid fill area. In the area of the example, forty-nine locations are available for pixels. The area is identified as a solid fill area, if at least seventy-five percent, or at least thirty-seven, of the pixels locations have a black pixel to be printed. This test is made to ensure the area has sufficient black ink that the overprinting of other ink colors are useful to urge black ink printed by the inkjets adjacent the inoperative inkjet into the gap left in the solid fill area by the inoperative inkjet. While a seven by seven pixel area can be used, other area sizes can be used and the areas need not be square. Moreover, the word "centered" as used in this paragraph also covers areas that have an even number of pixels in a row. Such an area centered on a column to be printed by an inoperative inkjet that ejects black ink can have one more column on one side of the inoperative inkjet column than the other side has.

Once the controller determines the rendered image data would be used to attempt to operate the inoperative inkjet to eject black ink into a solid fill area, the controller operates inkjets to eject ink that is a first color other than black into the solid fill area (block 116). These ink drops of the first color are then covered by black ink drops when the inkjets in the printhead ejecting black ink are operated to eject black ink into the solid fill area. A color of ink other than black is used because the inkjets that eject black ink in the vicinity of the inoperative inkjet are already being used to eject black ink into the area. Consequently, these inkjets cannot eject any additional substantive amount of black ink into the area. A single color of ink may be adequate for the dot gain effect described below, particularly in embodiments having one or more printheads that eject clear ink into the solid fill area. In some embodiments, however, such as the one shown in FIG. 1, ink of a color that is different than the first color and different than black ink is ejected into the solid fill area (block 122). The ejection of the second color of ink provides some additional advantages. For one, the additional ink amount aids the dot gain effect. For another, the combination of the two ink colors attenuate any distinctiveness of a single color and are less perceptible to human observers once the ink is spread. In one embodiment, the first and second colors of ink are cyan and magenta. As shown in FIG. 2, three colors of ink other than black can be ejected into pixels in the solid fill area to facilitate the spreading of black ink into the area in which the defective inkjet would eject ink. Additionally, the different colors other than black can be ejected in different orders to further neutralize any perception of color other than black in the solid fill area.

The process continues by the media bearing the printed image entering a nip between two rollers where the ink drops of the color other than black and the black ink drops in the solid fill area are spread to expand the area covered by the ink drops. Expanding the area covered by the ink drops is known as "dot gain" in the art. This dot gain effect moves a portion of the black ink in the solid fill area into the portion of the solid fill area into which the inoperative inkjet was to eject ink drops corresponding to the detected pixels in the image data (block 128). The ink of the other colors should be ejected close enough to the area where the inoperative inkjet would eject ink to enable the mass of the ink drops to help urge the black ink towards that area. Consequently, the ejecting of the other color ink drops (blocks 110, 116) is implemented with the controller operating the inkjets to eject the ink drops of the first color and the second color at a predetermined distance from the portion of the solid fill area into which the inoperative inkjet was to eject black ink drops. In one embodiment, the predetermined distance is no closer than two pixel positions from the portion of the solid fill area into which the inoperative inkjet was to eject ink drops corresponding to the detected pixels in the image data. This distance is shown in FIG. 2. In that figure, a seven pixel by seven pixel area is shown with the pixels to be printed by the inoperative inkjet in the middle column of the area. The cyan and magenta ink drops are ejected in the columns that are two pixels distant from this middle column. While a two pixel distance is appropriate for this embodiment, various ink formulations, nip pressures, and other factors can make other distances appropriate.

In FIG. 2, the ink drops of the colors other than black in columns 1 and 5 are depicted as being arranged in a straight column. In other embodiments, the ink drops of the colors other than black can be ejected in a staggered or zig-zag pattern to attenuate the perceptibility of the other colors in the solid fill area. In these and other embodiments, the ink drops of the other colors can be dispersed in a stochastic or diffuse pattern within the solid fill area. This distribution of the other color ink drops also aids in reducing the ability of human observers to notice the other colors in the black ink fill area.

In some of the embodiments that use the intermediate printing process, the dot gain effect occurs before the nip is encountered. That is, the ink mass on the layer of the release agent moves. Thus, some dot gain effect occurs prior to the ink entering the nip at the transfix roller where the pressure in the nip can further the dot gain effect. Additionally, movement of ink on the release agent layer and attenuated perceptibility of non-black ink color appear to be facilitated when black ink drops and ink drops of other colors are ejected by the same printhead. In embodiments in which black and non-black ink colors are ejected by the same printhead, ink drops that land on or close by previously ejected ink drops of different colors that share a common column may have time to coalesce before solidifying. These well mixed ink drops coalesce into heavier composite column strings that move and spread into adjacent columns of black ink more effectively and push the adjacent columns of black ink into the missing gap in the black solid fill area. This movement occurs both prior to and while entering the nip at the transfix roller and results in non-black colors being less perceptible in the black solid fill area. In inkjet printers that eject gel inks, the dot gain effect is obtained by the movement of the ink drops prior to the curing of the ink drops with radiation of an appropriate frequency. In these printers, the process 100 performs the operations of block 128 using pressurized air and/or heat to spread the cured gel ink for the dot gain effect, rather than pressure in a nip. Additionally, as noted above, printers that use clear ink alone to produce the dot gain effect implement the process 100 without performing the ejection of a second color of ink drops depicted in block 122.

Additionally, the ejecting of the other color ink drops (blocks 110, 116) is implemented with the controller operating the inkjets to eject the ink drops of the first color and the second color at a predetermined distance from an edge of the solid fill area. In one embodiment, the predetermined distance is no closer than two pixel positions from the edge of the solid fill area. The restraint on the placement of the other color ink drops with regard to the edge helps keep other color drops from being visible at the edges of the solid fill area. In the embodiment shown in FIG. 2, a one pixel distance from the edge is adequate for the ink drops of the colors other than black, while in other embodiments a distance of at least two pixels from an edge can be used for placement control of the other ink colors. In the embodiment of FIG. 2, an edge that extends in the cross-process direction is not used for ink drop placement, while the edges that extend in the process direction are used. In other embodiments, the edges in the cross-process and not the edges in the process direction could be used for other color ink drop placement in the solid fill area. In still other embodiments, all of the edges could be used. In this scenario, the columns in which the other colors of ink drops are ejected would stop at either the one pixel position or two pixel position from both edges extending in the cross-process direction.

In the print zone shown in FIG. 4, the inkjets that eject the other colors of ink eject ink into the solid fill area before the color unit 912 ejects black ink into the area. In other solid ink printers, a single printhead can have multiple rows of inkjet ejectors and one or more rows of inkjet ejectors can eject different colors of ink. Thus, the process of FIG. 1 can be used in printing devices having printheads that eject multiple colors of ink or, as discussed above and illustrated in FIG. 4, the process can be used to operate inkjets in different printheads to help fill in missing black ink in black solid fill areas.

The methods disclosed herein may be implemented by a processor being configured with instructions and related circuitry to perform the methods. Additionally, processor instructions may be stored on computer readable medium so they may accessed and executed by a computer to perform the methods for printing inks of colors other than black in solid fill areas to camouflage the absence of black ink in columns to be printed by an inoperative inkjet. Accordingly, storing such instructions on computer readable media within the printer shown in FIG. 3 to configure one or more controllers in the printer to perform the methods described above takes that printer out of the prior art. Such a printer would then be configured to operate inkjets to eject ink into black solid fill areas to enable the dot gain of black ink from adjacent areas into a gap where the inoperative inkjet would eject black ink.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating inkjets in a printer comprising:

detecting with a controller an inoperative inkjet in a printhead that ejects black ink;

detecting with the controller pixels corresponding to black ink in image data to be printed by the inoperative inkjet in a solid fill area; and operating with the controller inkjets to eject ink that is a first color other than black into the solid fill area into which the printhead ejects black ink with inkjets other than the inoperative inkjet, the ink drops of the first color being ejected to land at a predetermined distance from an edge of the solid fill area.

2. The method of claim 1 further comprising:

spreading in a nip the ink drops of the first color other than black and the black ink drops in the solid fill area to expand coverage of a portion of the black ink in the solid fill area into a portion of the solid fill area into which the inoperative inkjet was to eject ink drops corresponding to the detected pixels corresponding to black ink in the image data.

3. The method of claim 2 wherein the inkjets that eject ink of the first color and the inkjets that eject black ink are in a same printhead.

4. The method of claim 1 wherein the predetermined distance is no closer than two pixel positions from the edge of the solid fill area.

5. The method of claim 1 wherein the printhead that ejects black ink is configured to eject melted phase change ink.

6. A method for operating inkjets in a printer comprising:

detecting with a controller an inoperative inkjet in a printhead that ejects black ink;

detecting with the controller pixels corresponding to black ink in image data to be printed by the inoperative inkjet in a solid fill area; and operating with the controller inkjets to eject ink that is a first color other than black into the solid fill area into which the printhead ejects black ink with inkjets other than the inoperative inkjet;

operating with the controller inkjets to eject ink that is a second color other than black and other than the first color onto ink drops of the first color in the solid fill area into which the printhead ejects black ink with inkjets other than the inoperative inkjet, the first color ink drops and the second color ink drops being ejected to land at a predetermined distance that is no closer than two pixel positions from the portion of the solid fill area into which the inoperative inkjet was to eject ink drops corresponding to the detected pixels in the image data corresponding to black ink.

7. The method of claim 6 wherein the ink drops of the first color are cyan and the ink drops of the second color are magenta.

8. A method for operating inkjets in a printer comprising:

detecting with a controller an inoperative inkjet in a printhead that ejects black ink;

detecting with the controller pixels corresponding to black ink in image data to be printed by the inoperative inkjet in a solid fill area;

detecting with the controller that at least seventy-five percent (75%) of the pixels in the solid fill area are to be printed with black ink prior to enable operation of inkjets that eject an ink of a first color other than black into the solid fill area; and operating with the controller the inkjets that eject the first color of ink into the solid fill area into which the printhead ejects black ink with inkjets other than the inoperative inkjet.

* * * * *